US012428691B2

(12) United States Patent
Seo et al.

(10) Patent No.: US 12,428,691 B2
(45) **Date of Patent: *Sep. 30, 2025**

(54) COLD-ROLLED STEEL SHEET HAVING EXCELLENT BENDABILITY AND HOLE EXPANDABILITY AND METHOD FOR MANUFACTURING SAME

(71) Applicant: POSCO, Pohang-si (KR)

(72) Inventors: Chang-Hyo Seo, Gwangyang-si (KR); Yeon-Sang Ahn, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 889 days.

This patent is subject to a terminal disclaimer.

(21) Appl. No.: 16/471,226

(22) PCT Filed: Dec. 21, 2017

(86) PCT No.: PCT/KR2017/015288

§ 371 (c)(1),
(2) Date: Jun. 19, 2019

(87) PCT Pub. No.: WO2018/117711

PCT Pub. Date: Jun. 28, 2018

(65) Prior Publication Data

US 2020/0239976 A1 Jul. 30, 2020

(30) Foreign Application Priority Data

Dec. 22, 2016 (KR) ..... 10-2016-0176383

(51) Int. Cl.
*C21D 8/02* (2006.01)
*C21D 9/46* (2006.01)
(Continued)

(52) U.S. Cl.
CPC ..... *C21D 8/0236* (2013.01); *C21D 8/0205* (2013.01); *C21D 8/0226* (2013.01);
(Continued)

(58) Field of Classification Search
CPC ..... C21D 2211/005; C21D 2211/002; C21D 2211/008
See application file for complete search history.

(56) References Cited

U.S. PATENT DOCUMENTS

2003/0005986 A1 1/2003 Hasegawa et al.
2012/0031528 A1 2/2012 Hayashi et al.
(Continued)

FOREIGN PATENT DOCUMENTS

JP 2528387 8/1996
JP 2005272954 10/2005
(Continued)

OTHER PUBLICATIONS

KR-20160078570-A, Han Sang Ho; Han Seong Ho, English translation obtained from EPO, 2016 (Year: 2016).*
(Continued)

*Primary Examiner* — Jonathan Johnson
(74) *Attorney, Agent, or Firm* — CANTOR COLBURN LLP

(57) ABSTRACT

Provided are a cold-rolled steel sheet and a method for manufacturing same, the steel sheet containing, by weight %, 0.03 to 0.07% of C, 0.3% or less of Si, 2.0 to 3.0% of Mn, 0.01 to 0.10% of Sol·Al, 0.3 to 1.2% of Cr, 0.03 to 0.08% of Ti, 0.01 to 0.05 of Nb, 0.0010 to 0.0050% of B, 0.001-0.10% of P, 0.010% or less of S, 0.010% or less of N, the balance being Fe and other impurities, and having a microstructure comprising 75% or more to less than 87% by area of a transformed structure and 13 to 25% by area of ferrite, wherein the transformed structure includes martensite and bainite, the martensite has an average particle diameter of 2 μm or less, the bainite has an average particle diameter of 3 μm or less, the bainite fraction of 3 μm or more is 5% or less.

4 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/26*** | (2006.01) |
| ***C22C 38/32*** | (2006.01) |

(52) U.S. Cl.

CPC ..... *C21D 8/0273* (2013.01); *C21D 9/46* (2013.01); *C22C 38/001* (2013.01); *C22C 38/02* (2013.01); *C22C 38/04* (2013.01); *C22C 38/06* (2013.01); *C22C 38/14* (2013.01); *C22C 38/26* (2013.01); *C22C 38/32* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2014/0044989 | A1 | 2/2014 | Toda et al. |
| 2015/0322552 | A1 | 11/2015 | Takashima et al. |

FOREIGN PATENT DOCUMENTS

| | | | | | |
|---|---|---|---|---|---|
| JP | 3729108 | | | 12/2005 | |
| JP | 2010090432 | | | 4/2010 | |
| JP | 2016141816 | A | * | 8/2016 | |
| KR | 20100076409 | | | 7/2010 | |
| KR | 20130135348 | | | 12/2013 | |
| KR | 101620744 | | | 5/2016 | |
| KR | 101630975 | | | 6/2016 | |
| KR | 2016078570 | A | * | 7/2016 | ..... C21D 8/02 |
| KR | 20160078570 | | | 7/2016 | |
| KR | 20160078570 | A | * | 7/2016 | |
| WO | 2010137317 | | | 12/2010 | |

OTHER PUBLICATIONS

International Search Report—PCT/KR2017/015288 dated Apr. 3, 2018.

* cited by examiner

COLD-ROLLED STEEL SHEET HAVING EXCELLENT BENDABILITY AND HOLE EXPANDABILITY AND METHOD FOR MANUFACTURING SAME

TECHNICAL FIELD

The present disclosure relates to a cold-rolled steel sheet used for vehicle impact and structural members and a method for manufacturing the same, and more particularly, to a cold-rolled steel sheet having excellent bendability and hole expandability and a method for manufacturing the same.

BACKGROUND ART

Recently, steel sheets for vehicles have been required to be steel sheets with higher strength to improve fuel efficiency and durability by various environmental regulations and energy use regulations.

In detail, as the impact stability regulations of vehicles have been spreading recently, high strength steel having the excellent yield strength is applied to structural members such as a member, a seat rail, a pillar, and the like, to improve the impact resistance of a vehicle body.

As the yield strength to the tensile strength, that is, a yield ratio (yield strength/tensile strength) is higher, the structural member has better impact energy absorption capacity.

However, in general, as the strength of a steel sheet is increased, elongation is decreased. Thus, a problem may occur in that forming processability may be lowered, so the development of a material which could compensate for this problem is required.

In general, a method of strengthening steel includes solid solution strengthening, precipitation strengthening, strengthening by grain refinement, transformation strengthening, and the like. However, solid solution strengthening and strengthening by grain refinement, among the methods described above, have disadvantages, in that it is significantly difficult to manufacture high strength steel having tensile strength 490 MPa grade or more.

On the other hand, precipitation-strengthening type high-strength steel uses a technique to secure strength by refining grains through grain growth inhibition by a fine precipitate or strengthening a steel sheet by precipitating a carbide and a nitride by adding carbide and nitride forming elements such as Cu, Nb, Ti, V, and the like.

The technique has the advantage that high strength may be easily obtained, as compared to low manufacturing costs, but has the disadvantage that a recrystallization temperature is rapidly increased due to the fine precipitate, so high-temperature annealing is required to be performed in order to secure ductility by causing sufficient recrystallization. In addition, the precipitation strengthened steel, strengthened by precipitation of carbides and nitrides on a ferrite base, may have the problem that it is difficult to obtain high strength steel of 600 MPa grade or more.

Meanwhile, various types of transformation-strengthening type high strength steel have been developed, such as ferrite-martensite dual phase steel in which hard martensite is included in a ferrite base, Transformation Induced Plasticity (TRIP) steel using transformation-induced plasticity of residual austenite, or Complexed Phase (CP) steel formed of ferrite and a hard bainite or martensite structure.

However, tensile strength, which can be obtained in the advanced high strength steel described above, is limited to a degree of about 1200 Mpa grade (here, it is possible to increase the strength by increasing the amount of carbon, but considering the practical aspects such as point weldability, or the like). In addition, for application to a structural member to secure collision safety, Hot Press Forming steel, capable of securing final strength by quenching through direct contact with a die for water-cooling after forming at high temperature, is in the spotlight. However, in the case of Hot Press Forming steel, the application expansion of the Hot Press Forming steel is not great, due to excessive facility investment costs and high heat treatment and process costs.

Recently, in order to further improve the stability of passengers in the event of a collision, high strength and lightweight have been provided simultaneously in a seat component of a vehicle. Those components are manufactured using two methods, including not only roll forming, but also press forming. The seat component is the component for connection of the passenger and the vehicle body, and should be supported with high stress so that the passenger cannot be ejected in the case of a collision. To this end, the high yield strength and yield ratio are required. In addition, most of the processed components are components requiring elongation flangeability, and the application of a steel material having excellent hole expandability is required.

As a representative manufacturing method for increasing yield strength, water cooling is used in continuous annealing. In other words, manufactured is a steel sheet having a tempered martensite structure, in which in a microstructure, martensite is tempered by tempering after immersion in a water tank after cracking in an annealing process. However, such a method has significantly serious disadvantages such as deterioration in workability and variations in material for each position when roll forming is applied since a shape quality is low, due to a temperature deviation in a width direction and a length direction during water cooling. An example of the related techniques is Patent Document 1. In Patent Document 1, a steel material having carbon of 0.18% or more is water cooled to room temperature after continuous annealing, and then an overaging treatment is performed for 1 to 15 minutes at a temperature of 120° C. to 300° C., so a martensite steel material having a martensite volume rate of 80% to 97% or more is disclosed. As in Patent Document 1, when ultra high strength steel is manufactured using a tempering method after water cooling, a yield ratio is significantly high, but a problem may occur in that a shape quality of a coil is deteriorated due to the temperature deviation in a width direction and a length direction. Thus, problems such as a material defect, workability degradation, and the like, may occur in each region in a roll forming process.

In addition, in Patent Document 2, disclosed is a method for manufacturing a cold-rolled steel sheet in which tempering martensite is used to simultaneously have high strength and high ductility, and a sheet shape is also excellent after continuous annealing. In this case, the carbon is 0.2% or more, which is high, so weldability may be low, and the dent inside a furnace caused by containing a large amount of Si may be caused.

In addition, in Patent Document 3, a composition of a steel sheet and heat treatment conditions are optimized, so a high tension cold-rolled steel sheet formed of a martensite single-phase structure and having tensile strength of 880 MPa to 1170 MPa is disclosed. In Patent Document 4, a method for manufacturing a high tension steel sheet is disclosed. Here, a steel sheet, in which a volume ratio of a low temperature transformed phase, formed of martensite and residual austenite, occupies 90% or more of the entire metal structure, is heated and maintained in two phase regions. Thus, the steel sheet is controlled to have a structure of fine ferrite and austenite, including the lath with a low temperature transformed phase, and a metal structure in which ferrite and a low temperature transformed phase are finely dispersed on the lath finally after cooling thereafter is provided, thereby manufacturing the high tension steel sheet. These techniques claim that high yield strength could be obtained without processing such as water cooling, but there are disadvantages in that ductility is significantly deteriorated or a large amount of austenite is generated in steel to deteriorate stretch flangeability.

PRIOR ART DOCUMENT (Patent Document 1) Japanese Patent Laid-Open Publication No. 1990-418479

(Patent Document 2) Japanese Patent Laid-Open Publication No. 2010-090432

(Patent Document 3) Japanese Patent Publication No. 3729108

(Patent Document 4) Japanese Patent Laid-Open Publication No. 2005-272954

DISCLOSURE

Technical Problem

An aspect of the present disclosure may provide a cold-rolled steel sheet having a high yield ratio and excellent bendability and hole expandability.

Another aspect of the present disclosure may provide a method for manufacturing a cold-rolled steel sheet having a high yield ratio and excellent bendability and hole expandability.

Technical Solution

According to an aspect of the present disclosure, a cold-rolled steel sheet having excellent bendability and hole expandability includes 0.03 wt % to 0.07 wt % of carbon (C), 0.3 wt % or less of silicon (Si) (including 0 wt %), 2.0 wt % to 3.0 wt % of manganese (Mn), 0.01 wt % to 0.10 wt % of soluble aluminum (Sol·Al), 0.3 wt % to 1.2 wt % of chromium (Cr), 0.03 wt % to 0.08 wt % of titanium (Ti), 0.01 wt % to 0.05 wt % of niobium (Nb), 0.0010 wt % to 0.0050 wt % of boron (B), 0.001 wt % to 0.10 wt % of phosphorous (P), 0.010 wt % or less of sulfur (S) (including 0 wt %), 0.010 wt % or less of nitrogen (N) (including 0 wt %), and the balance being Fe and other impurities, and has a microstructure including 75% or more to less than 87% by area of a transformed structure and 13% to 25% by area of ferrite, the transformed structure includes martensite and bainite, the martensite has an average particle diameter of 2 μm or less, the bainite has an average particle diameter of 3 μm or less, the bainite fraction of 3 μm or more is 5% or less, and the interphase hardness ratio is 1.4 or less.

The transformed structure may have a hardness value (Hv) of, for example, 310 or more.

The steel sheet may have tensile strength of 780 MPa or more, yield strength of 650 MPa or more, elongation of 12% or more, R/t of 0.5 or less, a HER of 65% or more, and a yield ratio of 0.8 or more.

According to another aspect of the present disclosure, a method for manufacturing a cold-rolled steel sheet having excellent bendability and hole expandability includes:

obtaining a hot-rolled steel sheet by hot-rolling a steel slab under a finish rolling outlet temperature condition of Ar3 to Ar3+50° C. after reheating the steel slab including 0.03 wt % to 0.07 wt % of carbon (C), 0.3 wt % or less of silicon (Si) (including 0 wt %), 2.0 wt % to 3.0 wt % of manganese (Mn), 0.01 wt % to 0.10 wt % of soluble aluminum (Sol·Al), 0.3 wt % to 1.2 wt % of chromium (Cr), 0.03 wt % to 0.08 wt % of titanium (Ti), 0.01 wt % to 0.05 wt % of niobium (Nb), 0.0010 wt % to 0.0050 wt % of boron (B), 0.001 wt % to 0.10 wt % of phosphorous (P), 0.010 wt % or less of sulfur (S) (including 0 wt %), 0.010 wt % or less of nitrogen (N) (including 0 wt %), and the balance being Fe and other impurities; coiling the hot-rolled steel sheet at a temperature in a range of 600° C. to 750° C.;

Coiling the hot-rolled steel sheet at a temperature in a range of 600° C. to 750° C.;

obtaining a cold-rolled steel sheet by cold-rolling the hot-rolled steel sheet at a cold-reduction rate of 40% to 70%; and overaging treating the cold-rolled steel sheet after performing continuous annealing, primary cooling at a cooling rate of 1° C./sec to 10° C./sec to 650° C. to 700° C., and then secondary cooling at a cooling rate of 5° C./sec to 20° C./sec to a temperature section of Ms−100° C. to Ms° C., and $Ac_3$, an annealing temperature, Ms, and a secondary cooling finish temperature are satisfied with Relational Expression (1), $$0.9 \leq 0.055B - 0.07A \leq 2.8 \quad \text{[Relational Expression 1]}$$

where A: $Ac_3$— annealing temperature and B: Ms—secondary cooling finish temperature.

Advantageous Effects

According to an exemplary embodiment in the present disclosure, a cold-rolled steel sheet, having a high yield ratio, and excellent bendability and hole expandability, may be provided.

BEST MODE FOR INVENTION

Figure 1:
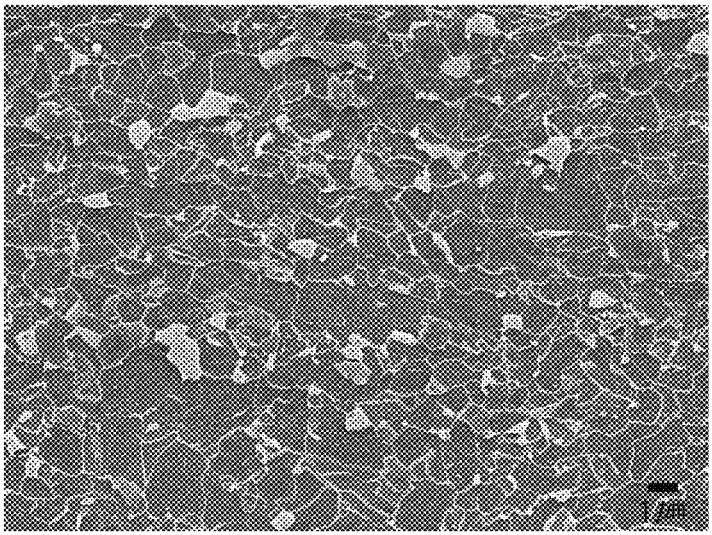
FIG. 1 is a structural image illustrating a microstructure of Inventive Example (4-1).

Hereinafter, the present disclosure will be explained.

In the present disclosure, in order to provide a cold-rolled steel sheet having a high yield ratio and having excellent bendability and hole expandability, it is important to appropriately control a steel composition, a microstructure, and a precipitate.

The main concept of the present disclosure is as follows.

1) A certain amount of hardenability elements such as Mn, Cr, or the like, is added.

By adding the hardenability elements, martensite could be secured even at a low cooling rate. Due to securing of martensite at a low cooling rate, problems such as material deviation and shape defect could be significantly reduced and productivity could be improved.

2) The carbon content is limited to 0.07% or less.

The carbon content, having the greatest influence on the weldability, is significantly reduced, thereby significantly reducing a problem such as weldability deterioration due to addition of alloying elements.

3) A transformed structure of a microstructure, a size of a transformed structure, and an interphase hardness ratio are appropriately specified.

By appropriately specifying that, the stretch flangeability and yield ratio may be improved.

4) A size and density distribution of a precipitate may be appropriately specified.

By appropriately specifying that, the stretch flangeability and yield ratio may be improved.

5) An annealing temperature and a secondary cooling finish temperature are appropriately controlled.

By appropriately controlling that, the excellent bendability, hole expandability, and elongation may be secured.

Hereinafter, a cold-rolled steel sheet having excellent bendability and hole expandability according to a preferred aspect of the present disclosure will be described.

A cold-rolled steel sheet having excellent bendability and hole expandability according to a preferred aspect of the present disclosure includes 0.03 wt % to 0.07 wt % of carbon (C), 0.3 wt % or less of silicon (Si) (including 0 wt %), 2.0 wt % to 3.0 wt % of manganese (Mn), 0.01 wt % to 0.10 wt % of soluble aluminum (Sol·Al), 0.3 wt % to 1.2 wt % of chromium (Cr), 0.03 wt % to 0.08 wt % of titanium (Ti), 0.01 wt % to 0.05 wt % of niobium (Nb), 0.0010 wt % to 0.0050 wt % of boron (B), 0.001 wt % to 0.10 wt % of phosphorous (P), 0.010 wt % or less of sulfur (S) (including 0 wt %), 0.010 wt % or less of nitrogen (N) (including 0 wt %), and the balance being iron (Fe) and other impurities.

Carbon (C): 0.03 wt % to 0.07 wt % (Hereinafter, it Will be Referred to as '%')

Carbon (C) is a significantly important element added to strengthen a transformed structure. Carbon promotes high strength and promotes the formation of martensite in transformation structure steel. As the carbon content increases, an amount of martensite in the steel increases.

However, the content of C exceeds 0.07%, strength of martensite is increased, but a difference in strength with ferrite having a low carbon concentration is also increased. Due to such a difference in strength, the fracture occurs easily at an interface between phases when stress is added, so that the stretch flangeability is lowered. In addition, due to low weldability, a welding defect occurs when components of the customer company are processed. If the carbon content is less than 0.03%, it may be difficult to secure the strength of martensite proposed in the present disclosure.

Thus, the content of C is preferably limited to 0.03% to 0.07%. More preferably, the content of C is 0.04% to 0.06%.

Silicon (Si): 0.3% or less (including 0%)

Silicon (Si) promotes ferrite transformation and increases the content of carbon in untransformed austenite to form a composite structure of ferrite and martensite, thereby hindering the increase in strength of martensite. In addition, since Si not only causes a surface scale defect in terms of surface properties but also deteriorates the phosphatability, it is preferably to limit the addition of Si. Thus, the content of Si is preferably limited to 0.3% or less. The content of Si is more preferably 0.2% or less, and still more preferably 0.12% or less.

Manganese (Mn): 2.0% to 3.0%

Manganese (Mn) is an element for refining a particle without damaging the ductility and completely precipitating sulfur in steel into MnS to prevent hot brittleness due to the formation of FeS and to strengthen the steel, and is an element for forming martensite more easily by lowering a critical cooling rate at which a martensite phase is obtained.

If the content of Mn is less than 2.0%, it may be difficult to secure the target strength in the present disclosure. If the content of Mn exceeds 3.0%, the possibility, in which a problem such as weldability, hot rolling properties, or the like may occur, is increased. Thus, the content of Mn is preferably limited to 2.0% to 3.0%, and more preferably 2.3% to 2.9%. The content of Mn is still more preferably 2.3% to 2.6%.

Soluble aluminum (Sol·Al): 0.01% to 0.10%

Soluble aluminum (Sol·Al) is an element effective for deoxidation in combination with oxygen in steel and for improving the martensitic hardenability by distributing carbon in ferrite to austenite with Si. If the content of Sol·Al is less than 0.01%, the above effect may not be secured. If the content of Sol·Al exceeds 0.1%, the above effect is not only saturated but also manufacturing costs are increased. Thus, the content of the soluble Al is preferably limited to 0.01% to 0.10%.

Chromium (Cr): 0.3% to 1.2%

Chromium (Cr) is an element added to improve hardenability of steel and secure high strength. In addition, in the present disclosure, Cr is an element playing an important role in the formation of martensite, a low temperature transformation phase. If the content of Cr is less than 0.3%, the above effect may not be secured. If the content of Cr exceeds 1.2%, not only the above effect is saturated but also cold rolling properties are deteriorated due to an excessive increase strength of the hot rolled steel. Thus, the content of Cr is preferably limited to 0.3% to 1.2%. The content Cr is more preferably 0.5% to 0.9%, and still more preferably 0.8% to 1.0%.

Titanium (Ti): 0.03% to 0.08% and Niobium (Nb): 0.01% to 0.05%

Ti and Nb are elements effective for increasing the strength of a steel sheet and for grain refinement due to nano precipitates. In the present disclosure, the content of Ti is limited to a range of 0.03% to 0.08%, and the content of Nb is limited to a range of 0.01% to 0.05%. If a large amount of Ti and Nb are added as in the present disclosure, Ti and Nb are combined with carbon to form significantly fine nano-precipitates. These nano-precipitates serve to strengthen a base structure and reduce a difference in hardness between phases.

If the contents of Ti and Nb are not satisfied with the minimum proposed in the present disclosure, the distribution density of nano-precipitates and an interphase hardness ratio are not satisfied with the value proposed in the present disclosure. In addition, if the contents of Ti and Nb exceed a maximum value proposed in the present disclosure, manufacturing costs may be increased and ductility may be significantly lowered due to excessive precipitates.

Thus, Ti and Nb are preferably limited to 0.03% to 0.08% and 0.01% to 0.05%, respectively.

The content Ti is more preferably 0.04% to 0.06%. The content of Nb is more preferably 0.02% to 0.04%.

Boron (B): 0.0010% to 0.0050%

Boron (B) is an element delaying the transformation of austenite into pearlite in a cooling process during annealing and is an element inhibiting the formation of ferrite and promoting the formation of martensite. However, if the content of B is less than 0.0010%, it is difficult to obtain the above effect. If the content of B exceeds 0.0050%, the cost may be increased due to an excessive ferro alloy. Thus, the content of B is preferably limited to 0.0010% to 0.0050%. The content of B is more preferably 0.0015% to 0.0035%.

Phosphorous (P): 0.001% to 0.10%

Phosphorous (P) plays the role of improving the in-plane anisotropy and improving the strength, as a substitutional alloying element having the most favorable solid solution strengthening effect. If the content of P is less than 0.001%, the above effect may not be secured and a problem in manufacturing costs may be caused. If P is added in an excessive amount, press formability may be deteriorated and brittleness of steel may be generated. In this regard, the content of P is preferably limited to 0.001% to 0.10%.

Sulfur (S): 0.010% or less (including 0%)

Sulfur (S) is an element hindering ductility and weldability of a steel sheet, as an impurity element in steel. If the content of S exceeds 0.010%, the possibility of deteriorating ductility and weldability of a steel sheet may be high. Thus, the content of S is preferably limited to 0.010% or less.

Nitrogen (N): 0.010% or less (including 0%)

Nitrogen (N) is an element effective in stabilizing austenite. If the content of N exceeds 0.01%, the risk of cracking during continuous casting through the formation of AlN is significantly increased. Thus, an upper limit of N is preferably limited to 0.01%.

In the present disclosure, the cold-rolled steel sheet includes iron (Fe) and other unavoidable impurities in addition to the above elements.

According to a preferred aspect of the present disclosure, a cold-rolled steel sheet having excellent bendability and hole expandability has a microstructure including 75% or more to less than 87% by area of a transformed structure and 13% to 25% by area of ferrite, the transformed structure includes martensite and bainite, the martensite has an average particle diameter of 2 μm or less, the bainite has an average particle diameter of 3 μm or less, the bainite fraction of 3 μm or more is 5% or less, and the interphase hardness ratio is 1.4 or less.

In the present disclosure, in order for a cold-rolled steel sheet to have excellent bendability, stretch flangeability, and a high yield ratio, it is significantly important to control a microstructure and a precipitate with a steel composition.

The fraction of the transformed structure is controlled to 75 area % or more to less than 87 area %. In this case, the transformed structure is formed of bainite and tempered martensite. In order to increase R/t, HER, and YR, a fraction of a transformed structure is increased if possible. However, in consideration of elongation, the transformed structure is preferably controlled to 75 area % or more to less than 87 area %, and more preferably 83 area % to 88 area %.

In order to increase strength, a size of the transformed structure is preferably decreased if possible. Moreover, it is preferable to limit the martensite to have an average particle diameter of 2 μm or less, the bainite to have an average particle diameter of 3 μm or less, and the bainite fraction of 3 μm or more to be 5% or less. If the average particle diameter of martensite is increased to be more than 2 μm or the average particle diameter of bainite is increased to be more than 3 μm, the bendability, stretch flangeability, and yield ratio, to be obtained in the present disclosure, may not be achieved.

In order to obtain the high yield strength, it is essential to secure martensite. However, if strength of tempered martensite is significantly low, a target yield ratio may not be secured. According to the research of the inventors, in order to secure a yield ratio of 0.8 or more, it is required that strength of a martensite phase is 310 Hv or more as a hardness ratio. Meanwhile, in terms of bendability and stretch flangeability, it is significantly important to control an interphase hardness ratio. In this regard, in order to simultaneously secure R/t of 0.5 or less and a HER of 65% or more, it is preferable to limit a hardness ratio of a soft phase and a hard phase in a microstructure to 1.4 or less. If the steel is not satisfied with a hardness value of a transformed phase and an interphase hardness ratio, it may be difficult to secure 0.5 or less of R/t, a HER value of 65% or more, and a YR value of 0.8 or more.

In the present disclosure, an average hardness value of a microstructure is controlled to 310 Hv or more, and an interphase hardness ratio is controlled to 1.4 or less. In order to control the hardness value and the interphase hardness ratio, it is required to form a nano-precipitate by controlling Ti and Nb elements. If the contents of Ti and Nb are not satisfied with the minimum proposed in the present disclosure, the distribution density of nano-precipitates and an interphase hardness ratio are not satisfied with the value proposed in the present disclosure. In addition, if the contents of Ti and Nb exceed a maximum value proposed in the present disclosure, manufacturing costs may be increased and ductility may be significantly lowered due to an excessive precipitate.

If the carbon content is low to 0.07% or less, when an alloying element is added in consideration of weldability and strength of the hot rolled steel, there is a limit in increasing the strength of the generated martensite. In other words, if a sufficient amount of carbon is not included in martensite, there is a limit in increasing strength, so a problem may occur in that the yield ratio could not be sufficiently increased. In the present disclosure, a fine precipitate is used to increase strength of a structure. In other words, according to the research of the present inventors, in order to improve the strength of a microstructure, it is preferable to significantly reduce a size of a precipitate, if possible. In detail, if a precipitate with 10 nm or less is secured to 150 precipitates/pmt or more, a high yield ratio of 0.8 or more, proposed in the present disclosure, is able to be secured. In addition, strength of a base structure is increased due to a fine precipitate in steel, a high strength steel sheet having an interphase hardness ratio of 1.4 or less, R/t of 0.5 or less, and a HER value of 65% or more, and having excellent bendability, stretch flangeability, and yield strength, may be manufactured.

Hereinafter, a method for manufacturing a cold-rolled steel sheet having excellent bendability and hole expandability according to a preferred aspect of the present disclosure will be described.

According to a preferred aspect of the present disclosure, a method for manufacturing a cold-rolled steel sheet having excellent bendability and hole expandability includes: reheating a steel slab having the above composition, and then hot-rolling under a finish rolling outlet temperature condition of $Ar_3$ to $Ar_3$+50° C. to obtain a hot-rolled steel sheet; coiling for coiling the hot-rolled steel sheet at a temperature in a range of 600° C. to 750° C.; cold rolling for cold-rolling the hot-rolled steel sheet at a cold-reduction rate of 40% to 70% to obtain a cold-rolled steel sheet; and overaging treating the cold-rolled steel sheet by performing continuous annealing, primary cooling at a cooling rate of 1° C./sec to 10° C./sec to 650° C. to 700° C., and then secondary cooling at a cooling rate of 5° C./sec to 20° C./sec to a temperature section of Ms−100° C. to Ms° C., and $Ac_3$, an annealing temperature, Ms, and a secondary cooling finish temperature are satisfied with Relational Expression (1).

$$0.9 \le 0.055B - 0.07A \le 2.8 \quad \text{[Relational Expression 1]}$$

Here, A: $Ac_3$— annealing temperature and B: Ms—secondary cooling finish temperature.

Hot Rolling

A steel slab, in which elements are prepared as described above, is hot rolled after reheating to obtain a hot-rolled steel sheet. In finish rolling during the hot rolling, it is preferable that rolling is performed at an outlet side temperature between $Ar_3$ and $Ar_3$+50° C.

If the outlet side temperature during the hot finish rolling is less than $Ar_3$, there is a high possibility that the hot deformation resistance is rapidly increased, and top and tail portions and edges of a hot-rolled coil are provided as a single phase region, and thus the in-plane anisotropy is increased and formability is deteriorated. If the outlet side temperature exceeds $Ar_3$+50° C., not only may significantly thick oxidation scale be generated, but the microstructure of a steel sheet may also be coarsened.

Coiling

After the hot finish rolling is finished, coiling is performed at 600° C. to 750° C. If a coiling temperature is less than 600° C., an excessive amount of martensite or bainite is generated, so strength of a hot-rolled steel sheet may be excessively increased. Thus, during cold rolling, a problem in manufacturing may occur such as a shape defect due to load. If the coiling temperature exceeds 750° C., pickling properties are deteriorated due to an increase in a surface scale. Thus, the coiling temperature is preferably limited to 600° C. to 750° C.

Cold Rolling

The hot-rolled steel sheet, manufactured using the above method, is pickled, and is then cold-rolled to obtain a cold-rolled steel sheet.

In the cold rolling, a reduction rate is preferably 40% to 70%. If the reduction rate is less than 40%, the recrystallization driving force is weakened, so a problem may occur in obtaining good recrystallized grains, and it is significantly difficult to correct a shape. If the reduction rate exceeds 70%, cracking may occur in an edge portion of a steel sheet, and the rolling load may be rapidly increased.

Continuous Annealing, Primary Cooling, Secondary Cooling, and Overaging Treatment The cold-rolled steel sheet, obtained as described above, is continuously annealed. If an annealing temperature is low, a large amount of ferrite is generated and the yield strength becomes low, so a yield ratio of 0.8 or more could not be secured. In detail, an interphase hardness ratio with a transformed phase is increased due to the formation of a large amount of ferrite. Thus, the conditions proposed in Inventive Steel, that is, the average hardness ratio of 310 Hv or more and the hardness difference of 1.4 or less, could not be satisfied.

Meanwhile, if an annealing temperature is high, due to an increase in a size of an austenite grain by the high temperature annealing, a size of a martensite packet, produced in cooling, is increased. Thus, it may be difficult to secure structures of martensite having an average particle diameter of 2 μm or less and bainite having an average particle diameter of 3 μm or less, proposed in the present disclosure.

The steel sheet, continuously annealed as described above, is primarily cooled at a cooling rate of 1° C./sec to 10° C./sec to 650° C. to 700° C. The primary cooling is provided to transform most of austenite into martensite by suppressing the ferrite transformation.

After the primary cooling, overaging treatment is performed after secondary cooling at a cooling rate of 5° C./s to 20° C./s to a temperature range of Ms−100° C. to Ms° C. The secondary cooling finish temperature is a significantly important temperature condition for securing a high yield ratio (YR) and high HER as well as securing a shape of a coil in a width direction and a longitudinal direction. If the secondary cooling finish temperature is significantly low, during the overaging treatment, due to an excessive increase in an amount of martensite, the yield strength and tensile strength are simultaneously increased, and ductility is significantly deteriorated. In detail, as the shape deterioration due to quenching occurs, it is expected that deterioration of workability in when a vehicle component is processed.

Meanwhile, if the secondary cooling finish temperature is significantly high, the austenite, generated during annealing, is not transformed into martensite, and a high temperature transformed phase, such as bainite, granular bainite, or the like, is generated, so a problem may occur in that the yield strength is rapidly deteriorated.

The generation of such a structure is accompanied by a decrease in the yield ratio and deterioration of the hole expandability, so that a high strength steel having excellent stretch flangeability and a high yield ratio, proposed in the present disclosure, may not be manufactured.

In the present disclosure, in order to secure high strength, a high yield ratio (YR), bending properties, in which a minimum R/t is 0.5 or less, a hole expansion ratio (HER), that is, hole expandability, of at least 65% or more, and elongation of 12% or more, $Ac_3$, an annealing temperature, Ms, and a secondary cooling finish temperature are preferably satisfied with Relational Expression (1).

$$0.9 \leq 0.055B - 0.07A \leq 2.8 \quad \text{[Relational Expression 1]}$$

Here, A: $Ac_3$— annealing temperature and B: Ms—secondary cooling finish temperature.

If B is great in Relational Expression 1 and a value in Relational Expression 1 exceeds 2.8, 90% or more of the austenite, generated during annealing, is transformed into martensite. Here, the strength, elongation, and bending properties are satisfied, but the deterioration of elongation may be caused.

If B is less and a value in Relational Expression 1 is less than 0.9, the austenite, generated during annealing by high temperature overaging, is transformed into not martensite, but a high temperature transformed phase such as bainite, granular bainite, or the like, resulting in generating a coarse transformed phase. In the coarse transformed phases, a microstructure has a low hardness value and a high interphase hardness ratio, resulting in having a low yield ratio and causing deterioration of a HER value.

If A is less and a value in Relational Expression 1 exceeds 2.8, an annealing temperature is significantly low, so annealing is performed in two phase regions, and Relational Expression 1, proposed in the present disclosure, is not satisfied. Thus, a transformed structure fraction may be less than 75%. In this case, it may cause a decrease in hardness value of a microstructure and a reduction in an interphase hardness ratio, resulting in having a low hardness value and causing deterioration of a HER value.

If A is great and a value in Relational Expression 1 is less than 0.9, due to an increase in size of an austenite grain by high temperature annealing, a size of a martensite packet, generated during cooling, is increased. In the present disclosure, a microstructure, in which an average particle diameter is 2 μm or less while an average particle diameter of bainite is 3 μm or less, is proposed. However, in this case, it may be difficult to secure the microstructure. Thus, the deterioration of the yield ratio and HER value may be caused.

On the cold-rolled steel sheet, which is heat-treated as described above, skin pass rolling may be performed thereon at a rate of pressure of 0.1% to 1.0%.

According to the related art, when transformed steel is skin pass rolled, the yield strength is increased by at least 50 Mpa or more, with little increase in tensile strength. If the rate of pressure is less than 0.1%, it may be difficult to control a shape. On the other hand, if the reduction exceeds 1.0%, due to the high stretching operation, the workability may be significantly unstable. Thus, the rate of pressure is preferably limited to 0.1% to 1.0%.

MODE FOR INVENTION

Hereinafter, a preferable example of the present disclosure will be explained through embodiments.

Example

A steel slab, prepared as illustrated in Table 1, was reheated for one hour at a temperature of 1200° C. in a heating furnace, and then hot rolling was performed under the conditions, illustrated in Table 2, to manufacture and coil a hot-rolled steel sheet.

The hot-rolled steel sheet was pickled, and then cold rolling was performed at a cold-reduction rate of 45% to manufacture a cold-rolled steel sheet.

Continuous annealing and secondary cooling (RCS) were performed on the cold-rolled steel sheet under the annealing conditions of Table 2, and then skin pass rolling was performed at a reduction rate of 0.2%. In this case, primary cooling was performed at a cooling rate of 3° C./sec to 5° C./sec to 650° C., and a cooling rate and a secondary cooling finish temperature to a temperature section of Ms-100° C. to Ms° C. are illustrated in Table 2.

In Table 2, FDT indicates a hot finish rolling temperature, CT indicates a coiling temperature, SS indicates a continuous annealing temperature, and RCS indicates a secondary cooling finish temperature.

With respect to the cold-rolled steel sheet, skin pass rolled as described above, a transformation fraction, an average particle diameter of martensite (M) and bainite (B), a transformed structure hardness value, an interphase hardness ratio, and the distribution of density of a nano-precipitate with 10 nm or less in steel were examined, and the results are illustrated in Table 3.

Here, for the hardness of a transformed structure, values except maximum and minimum values are used by measuring the 100 point under a load of 2 g using the nano-indenter (Nano-Indenter, NT110) devices in the square. In addition, bainite, martensite, and a nano-precipitate were evaluated by the FE-TEM. In particular, the size and distribution density of a nano-precipitate were evaluated by using the image analyzer (Image analysis) facility with the precipitate structure image measured by the FE-TEM. In addition, a fraction of the transformed structure was observed using SEM, and then the image analyzer (Image analysis) facility was used.

In addition, a JIS 5 tensile test specimen was manufactured, and then the yield strength (YS), tensile strength (TS), elongation (T-El), yield ratio (YR), R/t, and HER were measured, and the results are illustrated in Table 4.

Figure 2:
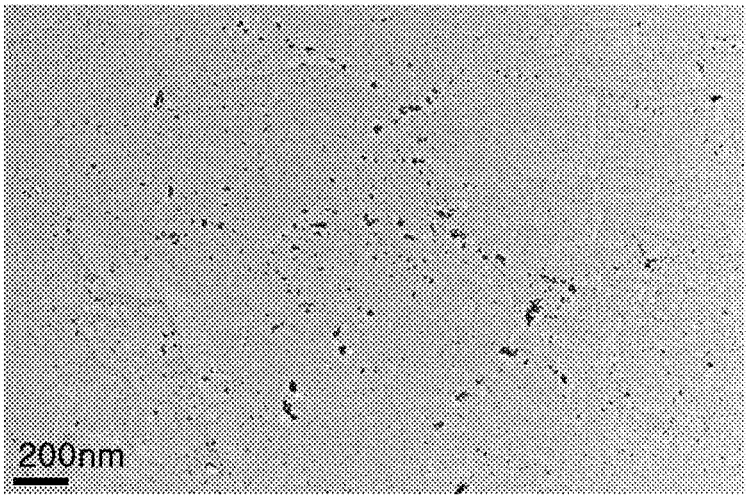
FIG. 2 is an image illustrating distribution of a fine precipitate of Inventive Example (4-1).

Meanwhile, with respect to Inventive Example (4-1), the distribution of a microstructure and a fine precipitate was observed, and the results are illustrated in FIGS. 1 and 2, respectively.

TABLE 1

| Steel | C | Mn | Si | P | S | Al | Cr | Ti | Nb | B | N | $Ac_3$ (° C.) | Ms (° C.) | Note |
|---|---|---|---|---|---|---|---|---|---|---|---|---|---|---|
| 1 | 0.039 | 2.51 | 0.097 | 0.011 | 0.0034 | 0.026 | 0.89 | 0.047 | 0.031 | 0.0021 | 0.004 | 874 | 435 | IS |
| 2 | 0.045 | 2.42 | 0.133 | 0.011 | 0.0036 | 0.024 | 0.92 | 0.045 | 0.031 | 0.002 | 0.005 | 873 | 435 | IS |
| 3 | 0.053 | 2.6 | 0.139 | 0.011 | 0.0033 | 0.022 | 0.85 | 0.044 | 0.031 | 0.002 | 0.004 | 869 | 427 | IS |
| 4 | 0.062 | 2.62 | 0.131 | 0.011 | 0.0032 | 0.023 | 0.78 | 0.043 | 0.031 | 0.0021 | 0.005 | 865 | 424 | IS |
| 5 | 0.054 | 2.54 | 0.108 | 0.011 | 0.0023 | 0.031 | 0.89 | 0.049 | 0.032 | 0.0022 | 0.003 | 868 | 428 | IS |
| 6 | 0.076 | 2.65 | 0.107 | 0.01 | 0.002 | 0.033 | 0.5 | 0.05 | 0.031 | 0.0023 | 0.003 | 859 | 420 | CS |
| 7 | 0.087 | 2.63 | 0.102 | 0.01 | 0.002 | 0.035 | 0.67 | 0.049 | 0.03 | 0.0025 | 0.003 | 855 | 414 | CS |
| 8 | 0.1 | 3.2 | 0.099 | 0.011 | 0.003 | 0.037 | 0.65 | 0.051 | 0.039 | 0.0035 | 0.003 | 850 | 392 | CS |
| 9 | 0.12 | 1.5 | 0.101 | 0.01 | 0.004 | 0.033 | 0.72 | 0.04 | 0.02 | 0.0029 | 0.003 | 844 | 434 | CS |
| 10 | 0.082 | 2.8 | 0.12 | 0.012 | 0.004 | 0.033 | 0.75 | 0.042 | 0.036 | 0.0029 | 0.003 | 857 | 410 | CS |
| 11 | 0.042 | 1.2 | 0.112 | 0.01 | 0.003 | 0.035 | 0.2 | 0.04 | 0.02 | 0.002 | 0.004 | 873 | 482 | CS |
| 12 | 0.052 | 1.8 | 0.112 | 0.01 | 0.003 | 0.035 | 0.12 | 0.043 | 0.031 | 0.002 | 0.004 | 869 | 461 | CS |
| 13 | 0.16 | 2.1 | 0.1 | 0.01 | 0.003 | 0.03 | 0.21 | 0.049 | 0.032 | 0.0024 | 0.004 | 833 | 405 | CS |
| 14 | 0.052 | 2.5 | 1 | 0.01 | 0.003 | 0.03 | 0.23 | 0.05 | 0.031 | 0.0024 | 0.004 | 908 | 438 | CS |
| 15 | 0.052 | 1.8 | 0.112 | 0.01 | 0.003 | 0.035 | 0.82 | 0.015 | 0 | 0.002 | 0.004 | 869 | 452 | CS |

[1] Inventive Steel: IS
[2] Comparative Steel: CS

TABLE 2

| Example No. | FDT(° C.) | CT(° C.) | SS(° C.) | RCS(° C.) | Secondary Cooling Rate (° C./s) | Note |
|---|---|---|---|---|---|---|
| 1-1 | 880 | 680 | 820 | 340 | 18 | IE |
| 1-2 | 880 | 680 | 820 | 350 | 17 | IE |
| 2-1 | 890 | 680 | 820 | 420 | 13 | CE |
| 2-2 | 880 | 680 | 820 | 330 | 19 | IE |
| 3-1 | 880 | 680 | 820 | 350 | 17 | IE |
| 3-2 | 880 | 680 | 820 | 300 | 20 | CE |
| 4-1 | 880 | 680 | 820 | 350 | 17 | IE |

TABLE 2-continued

| Example No. | FDT(° C.) | CT(° C.) | SS(° C.) | RCS(° C.) | Secondary Cooling Rate (° C./s) | Note |
|---|---|---|---|---|---|---|
| 4-2 | 880 | 680 | 820 | 300 | 20 | CE |
| 5-1 | 880 | 680 | 820 | 420 | 13 | CE |
| 5-2 | 880 | 680 | 800 | 330 | 19 | CE |
| 5-3 | 880 | 680 | 890 | 330 | 19 | CE |
| 5-4 | 880 | 650 | 820 | 330 | 19 | IE |
| 6 | 880 | 680 | 890 | 350 | 17 | CE |
| 7 | 880 | 680 | 820 | 350 | 17 | CE |
| 8 | 880 | 680 | 820 | 350 | 17 | CE |
| 9 | 880 | 680 | 820 | 350 | 17 | CE |
| 10 | 880 | 680 | 820 | 350 | 17 | CE |
| 11 | 880 | 680 | 820 | 350 | 17 | CE |
| 12 | 880 | 680 | 820 | 350 | 17 | CE |
| 13 | 880 | 680 | 820 | 350 | 17 | CE |
| 14 | 920 | 680 | 820 | 350 | 17 | CE |
| 15 | 880 | 680 | 820 | 350 | 17 | CE |

1) Inventive Example: IE
2) Comparative Example: CE

TABLE 3

| Example No. | Transformation Fraction (area %) | M Average Particle Size (μm) | B Average Particle Size(μm) | Hardness Value (Hv) | Interphase Hardness Ratio | Nanoprecipitate Density (/μm$^2$) | Note |
|---|---|---|---|---|---|---|---|
| 1-1 | 85 | 1.4 | 2.5 | 334 | 1.2 | 167 | IE |
| 1-2 | 83 | 1.3 | 2.3 | 324 | 1.3 | 182 | IE |
| 2-1 | 71 | 2.2 | 3.4 | 291 | 2.1 | 179 | CE |
| 2-2 | 85 | 1.6 | 2.6 | 331 | 1.3 | 181 | IE |
| 3-1 | 84 | 1.1 | 2.7 | 342 | 1.2 | 162 | IE |
| 3-2 | 93 | 1 | 2.5 | 348 | 1.3 | 162 | CE |
| 4-1 | 86 | 1.4 | 2.8 | 347 | 1.2 | 158 | IE |
| 4-2 | 95 | 1.3 | 2.8 | 356 | 1.2 | 158 | CE |
| 5-1 | 72 | 1.5 | 3.7 | 287 | 2.4 | 162 | CE |
| 5-2 | 71 | 1.9 | 3.8 | 270 | 3.2 | 161 | CE |
| 5-3 | 89 | 2.8 | 4.1 | 361 | 1.4 | 168 | CE |
| 5-4 | 84 | 1.5 | 2.6 | 336 | 1.3 | 158 | IE |
| 6 | 89 | 1.4 | 2.5 | 340 | 1.4 | 159 | CE |
| 7 | 92 | 1.5 | 2.3 | 354 | 1.4 | 161 | CE |
| 8 | 93 | 1.6 | 2.5 | 365 | 1.3 | 159 | CE |
| 9 | 97 | 1.2 | 2.4 | 373 | 1.4 | 160 | CE |
| 10 | 100 | 1.3 | 2.3 | 2.1 | 2.5 | 159 | CE |
| 11 | 74 | 1.5 | 2.8 | 294 | 2.1 | 153 | CE |
| 12 | 71 | 1.7 | 2.8 | 302 | 2.5 | 158 | CE |
| 13 | 82 | 2.7 | 3.5 | 312 | 3.2 | 159 | CE |
| 14 | 72 | 4.2 | 3.4 | 273 | 2.1 | 158 | CE |
| 15 | 82 | 1.8 | 2.8 | 278 | 2.5 | 82 | CE |

1) Inventive Steel: IS
2) Comparative Steel: CS

TABLE 4

| Example No. | YS(Mpa) | TS(Mpa) | T-EI(%) | R/t | HER(%) | YR | Equation 1) | Note |
|---|---|---|---|---|---|---|---|---|
| 1-1 | 720 | 870 | 12.9 | 0 | 78 | 0.83 | 1.5 | IE |
| 1-2 | 682 | 852 | 13.1 | 0.3 | 74 | 0.80 | 0.9 | IE |
| 2-1 | 582 | 856 | 14.1 | 1.2 | 45 | 0.68 | −2.9 | CE |
| 2-2 | 689 | 852 | 12.4 | 0.3 | 76 | 0.81 | 2.8 | IE |
| 3-1 | 712 | 856 | 13.1 | 0.3 | 71 | 0.83 | 1.5 | IE |
| 3-2 | 742 | 842 | 11.2 | 0.3 | 74 | 0.88 | 3.5 | CE |
| 4-1 | 679 | 851 | 12.9 | 0.3 | 70 | 0.80 | 0.9 | IE |
| 4-2 | 682 | 841 | 10.9 | 0.3 | 69 | 0.81 | 3.6 | CE |
| 5-1 | 612 | 845 | 13.1 | 1.2 | 47 | 0.72 | −2.9 | CE |
| 5-2 | 591 | 872 | 15.3 | 1.2 | 35 | 0.68 | 0.7 | CE |
| 5-3 | 652 | 872 | 12.5 | 0.6 | 52 | 0.75 | 7.0 | CE |
| 5-4 | 689 | 864 | 12.8 | 0.3 | 74 | 0.80 | 2.1 | IE |
| 6 | 642 | 864 | 11.3 | 1.2 | 45 | 0.74 | 6.0 | CE |

TABLE 4-continued

| Example No. | YS(Mpa) | TS(Mpa) | T-El(%) | R/t | HER(%) | YR | Equation 1) | Note |
|---|---|---|---|---|---|---|---|---|
| 7 | 652 | 920 | 11.2 | 0.6 | 56 | 0.71 | 1.1 | CE |
| 8 | 642 | 910 | 10.6 | 0.6 | 43 | 0.71 | 0.2 | CE |
| 9 | 645 | 924 | 10.9 | 1.2 | 41 | 0.70 | 2.9 | CE |
| 10 | 623 | 912 | 12.1 | 1.8 | 49 | 0.68 | 0.7 | CE |
| 11 | 621 | 823 | 14.5 | 1.6 | 42 | 0.75 | 3.5 | CE |
| 12 | 534 | 781 | 15.6 | 1.6 | 38 | 0.68 | 2.7 | CE |
| 13 | 634 | 820 | 13.6 | 0.6 | 47 | 0.77 | 2.1 | CE |
| 14 | 582 | 852 | 14.3 | 1.2 | 47 | 0.68 | −1.3 | CE |
| 15 | 512 | 762 | 15.8 | 1.2 | 41 | 0.67 | 2.2 | CE |

1) Inventive Steel: IS
2) Comparative Steel: CS

As illustrated in Table 1 to Table 4, in the case of Inventive Examples, satisfying the steel composition, the microstructure, the precipitate, and the manufacturing conditions of the present disclosure, tensile strength is 780 MPa or more, yield strength is 650 MPa or more, the yield ratio is 0.8 or more, R/t is 0.5 or less, the elongation is 12% or more, and the HER value is 65% or more.

As illustrated in FIGS. 1 and 2, in the case of Inventive Example (4-1), it can be seen that a transformed structure fraction and the distribution of a fine precipitate are provided in accordance with the present disclosure.

On the other hand, in the cases of Comparative Steel 3-2 and Comparative Steel 4-2, the elements are satisfied with the conditions of the present disclosure, but the secondary cooling finish temperature (RCS) is 300° C. In this case, Relational Expression 1, proposed in the present disclosure, is not satisfied. Here, 90% or more of the austenite, generated during annealing by high temperature overaging, is transformed into martensite, so strength, elongation, and bendability were satisfied, but deterioration of elongation was caused.

In the cases of Comparative Steel 2-1 and Comparative Steel 5-1, elements are satisfied with the conditions of the present disclosure, but the secondary cooling finish temperature (RCS) is 420° C. In this case, Relational Expression 1, proposed in the present disclosure, is not satisfied. Here, the austenite, generated during annealing by high temperature overaging, is not transformed not into martensite, but into a high temperature transformed phase, such as bainite, granular bainite, or the like, so a coarse transformed phase was generated. In the coarse transformed phases, a microstructure had a low hardness value and a high interphase hardness ratio, resulting in having a low yield ratio and causing deterioration of a HER value.

In the case of Comparative Steel 5-2, an annealing temperature is significantly low, so annealing was performed in two phase regions. In this case, Relational Expression 1, proposed in the present disclosure, is not satisfied. Thus, a transformed structure fraction is 71%, which is less than a target of the Inventive Steel. The generation of ferrite may cause a decrease in hardness value of a microstructure and a reduction in an interphase hardness ratio, resulting in having a low hardness value and causing deterioration of a HER value.

In the case of Comparative Steel 5-3, an annealing temperature is 890° C., significantly high, and Relational Expression 1, proposed in the present disclosure, is not satisfied. In this case, due to an increase in a size of an austenite grain by the high temperature annealing, a size of a martensite packet, produced in cooling, is increased. In the present disclosure, a microstructure, in which an average particle diameter is 2 μm or less while an average particle diameter of bainite is 3 μm or less, is proposed. However, in this case, it may be difficult to secure the microstructure. Thus, the yield ratio and HER value were deteriorated.

In the cases of Comparative Steels 6 to 10, the carbon content exceeded the composition range of the carbon, proposed in the present disclosure. The increase in the carbon may serve to increase strength of martensite, generated in a quenching process after annealing. However, during overaging treatment after quenching, all martensite may not be tempered, but may remain as a lath type. In the case of the tempered martensite generated at this time, due to precipitation of carbon, strength may be decreased. On the other hand, the lath type martensite, which is not tempered, is the significantly stable martensite, and may have significantly high strength due to the added carbon. Therefore, if the carbon content exceeds the elements proposed in the present disclosure, due to an increase in the strength difference between the lath martensite and the tempered martensite, generated in the overaging treatment, the HER value and the yield ratio may not be satisfied with the criteria proposed in the present disclosure.

In the cases of Comparative Steels 11 to 13, the carbon content or the contents of Mn and Cr may not be satisfied with the range of the present disclosure. In other words, in the cases of Comparative Steels 11 and 12, due to the low content of Mn or Cr, transformation of martensite in a sufficient amount did not occur. Moreover, in the case of Comparative Steel 13, although the carbon content was high, the content of Cr was low. Thus, an interphase hardness ratio was high and coarse martensite was generated, resulting in deterioration of the yield ratio and HER value.

In the case of Comparative Steel 14, the content of Si is higher than the range of the present disclosure. According to the related art, as an amount of addition of Si, as a ferrite forming element, is increased, ferrite formation upon cooling is promoted. In the case of No. 14 steel, an amount of a transformed structure, generated due to the high Si addition, is 72%, which did not satisfy the criteria proposed in the present disclosure. In this case, due to a decrease in a hardness value in a microstructure and an increase in an interphase hardness ratio, a yield ratio was low and a HER value was deteriorated.

In the case of Comparative Steel 15, Ti and Nb are not satisfied with the conditions of the present Inventive Steel. Ti and Nb are combined with a carbon to form a nano-precipitate, and the nano-precipitate strengthens a base structure to reduce a difference in hardness between phases. However, in the case of Comparative Steel 15, Ti and Nb are added in a significantly small amount, so a sufficient precipitate may not be formed. Thus, due to the nano-precipitate distribution, an increase in an interphase hardness ratio, the yield ratio and the HER value were deteriorated.

The invention claimed is:

1. A cold-rolled steel sheet comprising:

0.03 wt % to 0.054 wt % of carbon (C), 0.3 wt % or less of silicon (Si) (including 0 wt %), 2.0 wt % to 3.0 wt % of manganese (Mn), 0.01 wt % to 0.10 wt % of soluble aluminum (Sol·Al), 0.3 wt % to 1.2 wt % of chromium (Cr), 0.03 wt % to 0.08 wt % of titanium (Ti), 0.01 wt % to 0.05 wt % of niobium (Nb), 0.0010 wt % to 0.0050 wt % of boron (B), 0.001 wt % to 0.10 wt % of phosphorous (P), 0.010 wt % or less of sulfur(S) (including 0 wt %), 0.010 wt % or less of nitrogen (N) (including 0 wt %), and the balance being iron (Fe) and other impurities;

a microstructure consisting of 75% or more to less than 87% by area of a transformed structure and 13% to 25% by area of ferrite, wherein the transformed structure includes martensite and bainite; and a tensile strength of 780 MPa or more, an R/t of 0.5 or less, a hole expansion ratio (HER) of 65% or more, and a yield ratio of 0.8 or more, wherein the martensite has an average particle diameter of 2 μm or less, the bainite has an average particle diameter of 3 μm or less, and a fraction of the bainite having a particle diameter of 3 μm or more is 5% or less, and wherein a ratio of a hardness value (Hv) of the transformed structure to that of the ferrite is 1.4 or less, and the hardness value (Hv) of the transformed structure is 310 or more.

2. The cold-rolled steel sheet of claim 1, wherein the transformed structure has a fraction of 83% to 87% by area.

3. The cold-rolled steel sheet of claim 1, further comprising: a precipitate with 10 nm or less of diameter, provided as 150 precipitates/$\mu m^2$ or more.

4. The cold-rolled steel sheet of claim 1, further comprising: a yield strength of 650 MPa or more, and an elongation of 12% or more.

* * * * *